US010976102B2

(12) United States Patent
Fisel et al.

(10) Patent No.: US 10,976,102 B2
(45) **Date of Patent: *Apr. 13, 2021**

(54) LIQUIEFYING A GASEOUS MEDIUM

(71) Applicant: LINDE AKTIENGESELLSCHAFT, Munich (DE)

(72) Inventors: Wolfgang Fisel, Dubendorf (CH); Lukas Keller, Winterthur (CH); Kim Rautert, Winterthur (CH)

(73) Assignee: LINDE AKTIENGESELLSCHAFT, Munich (DE)

( * ) Notice: Subject to any disclaimer, the term of this patent is extended or adjusted under 35 U.S.C. 154(b) by 103 days.

This patent is subject to a terminal disclaimer.

(21) Appl. No.: 16/043,742

(22) Filed: Jul. 24, 2018

(65) Prior Publication Data

US 2019/0032995 A1 Jan. 31, 2019

(30) Foreign Application Priority Data

Jul. 25, 2017 (GB) ..... 1711975

(51) Int. Cl.

*F17C 9/02* (2006.01)
*F25J 1/02* (2006.01)
*F25J 1/00* (2006.01)

(52) U.S. Cl.

CPC ..... *F25J 1/0248* (2013.01); *F25J 1/001* (2013.01); *F25J 1/002* (2013.01); *F25J 1/0007* (2013.01); *F25J 1/0015* (2013.01); *F25J 1/0017* (2013.01); *F25J 1/0022* (2013.01); *F25J 1/0025* (2013.01); *F25J 1/0247* (2013.01); *F25J 2210/42* (2013.01); *F25J 2210/50* (2013.01); *F25J 2210/58* (2013.01); *F25J 2210/60* (2013.01); *F25J 2210/90* (2013.01); *F25J 2245/02* (2013.01); *F25J 2245/90* (2013.01); *F25J 2280/10* (2013.01); *F25J 2290/62* (2013.01)

(58) Field of Classification Search

CPC ..... F17C 9/02; F17C 2265/033; F17C 2265/032; F17C 2265/031; F17C 2265/034; F25J 1/0025; F25J 1/024

See application file for complete search history.

(56) References Cited

U.S. PATENT DOCUMENTS 4,421,537 A * 12/1983 Kuraoka ..... F25J 1/0007 62/608
4,675,037 A * 6/1987 Newton ..... F25J 1/0247 62/48.2
2007/0068176 A1* 3/2007 Pozivil ..... F17C 13/082 62/45.1

(Continued)

*Primary Examiner* — Brian M King
(74) *Attorney, Agent, or Firm* — Millen White Zelano & Branigan, PC; Brion P. Heaney

(57) ABSTRACT

An arrangement comprising at least one liquefaction plant for liquefying a gaseous medium to produce a liquefied medium; and at least one storage tank for storing the liquefied medium. At least one first transfer line is connected between the liquefaction plant and the storage tank, for transferring liquefied medium from the liquefaction plant into the storage tank. At least one second transfer line is connected between the liquefaction plant and the storage tank, for transferring gaseous medium from the storage tank into the liquefaction plant. At least one shut-off valve is provided in each transfer line. The apparatus further includes a bypass line.

16 Claims, 2 Drawing Sheets

(56) References Cited

U.S. PATENT DOCUMENTS

2009/0071171 A1* 3/2009 Zia ..... F17C 3/00
62/47.1
2019/0011179 A1* 1/2019 Tezuka ..... F25J 1/0201

* cited by examiner

LIQUIEFYING A GASEOUS MEDIUM

FIELD OF THE INVENTION

The invention relates to an arrangement for liquefying a gaseous medium having at least one storage tank used for storing the liquefied medium. The invention further relates to a method for cooling the transfer lines prior to use.

BACKGROUND OF THE INVENTION

The term "liquefaction plant" is understood to mean any plant or any process that is used for cooling and liquefying a gaseous medium, for example, hydrogen, a noble gas such as helium, neon, etc., oxygen, nitrogen, or a hydrocarbon mixture, in particular natural gas.

In known arrangements, there is provided at least one liquefaction plant for liquefying a gaseous medium and at least one storage tank which is used to store the liquefied medium. Generally, two transfer lines are provided which connect the liquefaction plant and the storage tank. A first transfer line is used to transfer the liquefied medium from the liquefaction plant to the storage tank, and a second transfer line (a return line) is used to transfer flash and boil-off gas of the liquefied medium from the storage tank to the liquefaction plant. It is usual to provide a mechanism, such as a shut-off valve, in each transfer line which can be activate to stop the flow in the transfer line.

Usually, the transfer lines are vacuum insulated lines. By providing two, distinct and physically separated transfer lines between liquefaction plant and storage tank, it is possible at the same time to transfer liquefied medium from the liquefaction plant into the storage tank and gaseous medium from the storage tank into the liquefaction plant.

During a standstill phase (non-operational phase) of the liquefaction plant, the transfer lines are heated up due to heat exchange with the environment. Therefore, when the liquefaction plant is started up again it is necessary, to first cool the transfer lines again to an operational temperature which is the temperature corresponding substantially to the temperature of the medium stored in the storage tank. For this purpose, in known arrangements, the liquefied medium is fed from the liquefaction plant via one of the transfer lines into the storage tank and transferred back from said storage tank via the other transfer line back into the liquefaction plant.

However, at the beginning of this transfer line cooling procedure, the medium flowing from the liquefaction plant into the storage tank and back again into the liquefaction plant absorbs the heat which was introduced into the transfer lines (due to the environmental heat exchange as described above) and conveys this heat into the storage tank and/or into the liquefaction plant. If the storage tank contains any stored liquefied medium during this cooling procedure, undesired evaporation of medium occurs when the inflowing medium and stored liquid medium collide, since a pressure increase in the storage tank occurs due to the density difference between the inflowing and the stored medium. This undesired pressure increase can interfere with the stability of the process and, in addition, it can lead to activation of the mandatory pressure safety system of the storage tank and to the need to drain medium from the storage tank.

Embodiments of the invention seek to provide an apparatus which overcome some or all of these problems.

SUMMARY OF INVENTION

According to a first aspect, there is provided an arrangement or system comprising at least one liquefaction plant for liquefying a gaseous medium to produce a liquefied medium; and at least one storage tank for storing the liquefied medium, at least one first transfer line connected between the liquefaction plant and the storage tank, for transferring liquefied medium from the liquefaction plant into the storage tank;

at least one second transfer line connected between the liquefaction plant and the storage tank, for transferring gaseous medium from the storage tank into the liquefaction plant, and at least one shut-off valve provided in each transfer line, wherein the apparatus further includes a bypass line connecting the at least one first transfer line to the at least one second transfer line; and a bypass shut-off valve provided in the by-pass line, wherein the bypass line connects the transfer lines at a point between the liquefaction plant and the transfer line shut-off valves.

The apparatus may include one first transfer line and one second transfer line. The by-pass line may connect the first transfer line to the second transfer line.

The apparatus may comprise multiple first transfer lines and multiple second (return) transfer lines. Where multiple first and second transfer lines are provided, further by pass lines may be provided. For example, a secondary by-pass line may be provided between secondary first and second transfer lines.

The arrangement may further comprise a control element. The control element may be configured such that after a standstill phase of the liquefaction plant and before the transfer of liquefied medium from the liquefaction plant into the storage tank, it (the control element) carries out a transfer line cooling phase. The cooling phase may include that the control element closes transfer line shut-off valves and opens bypass line shut-off valve(s), so that liquefied medium is led from the liquefaction plant via partial sections of the transfer lines and the bypass line back into the liquefaction plant.

The bypass line may be arranged substantially adjacent to the storage tank. The bypass line may be routed so that at least part of its length is substantially parallel to the inner wall of the storage tank. The bypass line may be routed at along the inner wall of the storage tank, a minimal separation such that the line is surrounded in use by the liquefied medium. Advantageously, the bypass line is arranged in the immediate vicinity of the storage tank. The term "arranged in the immediate vicinity of the storage tank" is understood to mean an arrangement of the bypass line in which said bypass line is arranged as close as constructively possible to the storage tank.

By means of this implementation, the lengths of those sections of the transfer lines that do not come in direct contact, during the cooling phase, with the medium circulating via the transfer lines and the bypass line are reduced or minimized. In other words, a maximum length of the transfer lines is cooled during the cooling phase. This means that only the relatively short length between the valves and the storage tank is not cooled.

The arrangement may further comprise a first transfer line having a first shut-off valve. The arrangement may further comprise a second transfer line having a second shut-off valve. The bypass line may be connected between a point on the first transfer line upstream of the first shut-off valve and a point on the second transfer line downstream of the second shut-off valve.

The second transfer line used for transferring medium from the storage tank into the liquefaction plant may be arranged so that it is routed at least partially through the area of the storage tank in which the liquefied medium is stored in use.

An outlet of the first transfer line into the storage tank may be provided adjacent to a first side wall of the tank. An inlet of the second transfer line may be provide adjacent to a second side wall of the tank, provided on the opposite side of the tank to the first wall.

The transfer line used for transferring medium from the storage tank into the liquefaction plant may be arranged so that it is not routed through the area of the storage tank in which the liquefied medium is stored in use.

The storage tank may be a double-walled tank. The storage tank may have an outer tank and an inner tank. The storage tank may be a double-walled, vacuum insulated storage tank.

At least some of the transfer lines may be vacuum insulated. Alternatively, all of the transfer lines may be vacuum insulated.

According to a second aspect, there is provided a method for cooling the transfer lines of an arrangement as described in any of the statements above after a standstill phase of the liquefaction plant, the method comprising operating in a cooling mode which includes feeding the liquid medium through a by-pass line connected to both the first transfer line and the second transfer line, so as to by-pass the storage tank, switching to a normal transfer mode comprising transferring the liquefied medium from the liquefaction plant into the storage tank.

The cooling mode may comprise:

closing the transfer line shut-off valves, and opening the bypass line shut-off valve so that liquefied medium is led from the liquefaction plant via the transfer lines and the bypass line back into the liquefaction plant.

The cooling mode may be carried out until a predetermined temperature has been reached in at least one defined section of the transfer lines.

The medium to be liquefied may be hydrogen, a noble gas, in particular helium, neon or argon, oxygen, nitrogen, or a hydrocarbon mixture, more particularly a natural gas.

According to the invention, during the cooling phase, the medium flow circulating through the transfer lines is no longer fed through the storage tank, so that no introduction of heat from the transfer lines to be cooled into the storage tank occurs during the cooling phase. The evaporation of medium stored in the storage tank is thus reduced or completely avoided when the liquefaction plant is started up again, which results in the implementation of a more stable operation of the liquefaction plant, and the risk of activation of the pressure safety system of the storage tank can be reduced.

Whilst the invention has been described above, it extends to any inventive combination of features set out above or in the following description or drawings.

BRIEF DESCRIPTION OF THE DRAWINGS

Specific embodiments of the invention will now be described in detail by way of example only and with reference to the accompanying drawings in which.

DESCRIPTION OF EMBODIMENTS

Figure 1:
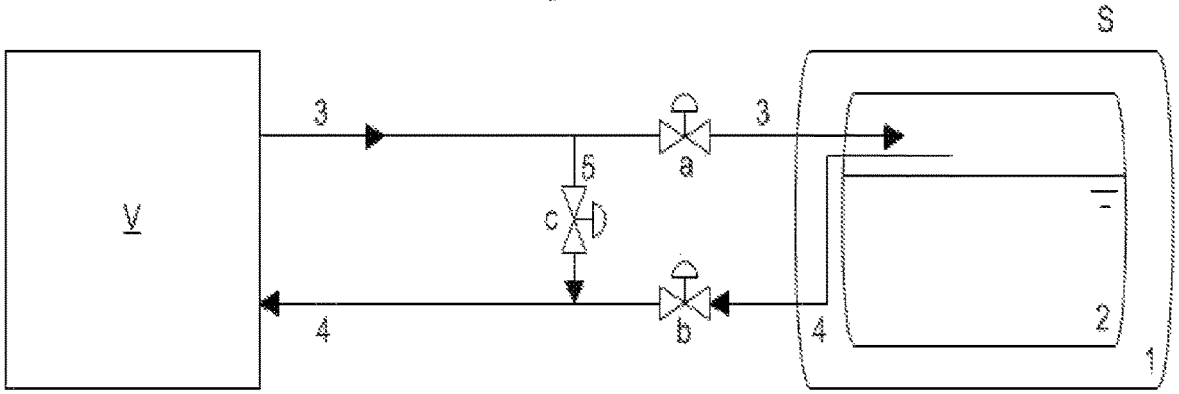
FIG. 1 shows an arrangement according to a first embodiment of the invention.
Figure 2:
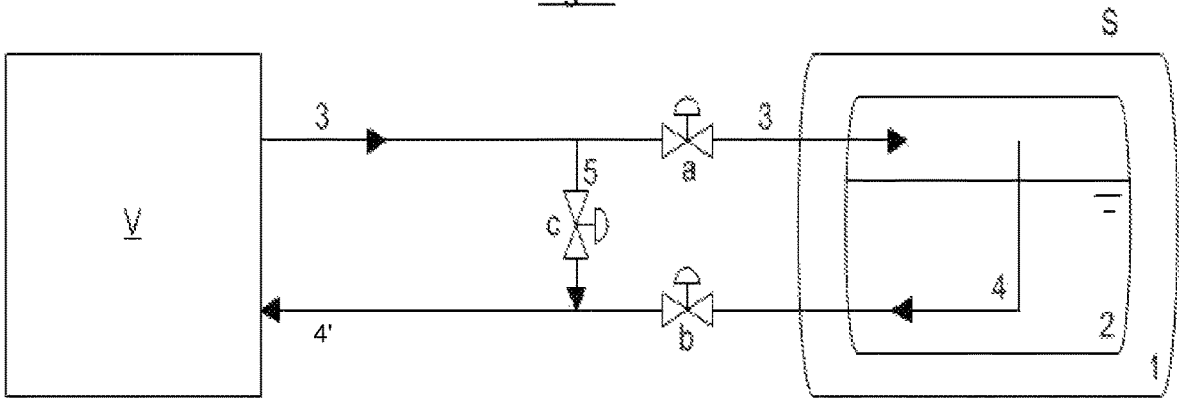
FIG. 2 shows an arrangement according to a second embodiment of the invention.
Figure 3:
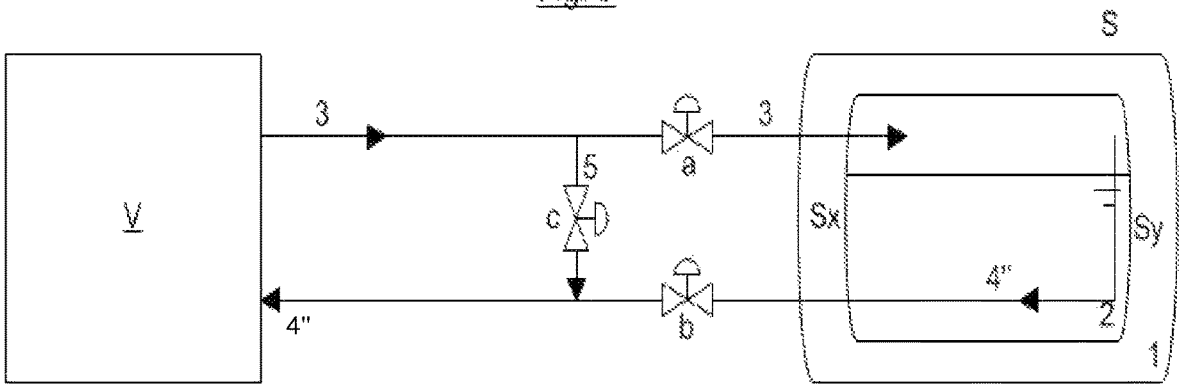
FIG. 3 shows an arrangement according to a third embodiment of the invention.

FIGS. 1, 2 and 3 each show a liquefaction plant V represented simply as a black box, as well as a diagrammatically represented storage tank S.

FIG. 1 shows the storage tank S, comprising an outer tank 1 and an inner tank 2, wherein the clearance between inner tank 1 and outer tank 2 is vacuum insulated. The arrangement includes a first transfer line 3 having a shut off valve a; and a second transfer line 4 having a shut-off valve b. The medium liquefied in the liquefaction plant V is supplied to the storage tank S via the first transfer line 3. A gaseous medium is transferred from the storage tank S into the liquefaction plant V via the transfer line 4.

A by-pass line 5 is provided between the first transfer line 3 and the second transfer line 4, and a shut-off valve c is provided in the by-pass line 5. The bypass line 5 connects the first transfer line 3 at a point between the liquefaction plant V and the shut-off valve a to the second transfer line 4 at a point between the liquefaction plant V and the shut-off valve b. In other words, the by-pass line 5 is connected to the first transfer line 3 upstream of shut-off valve a and connected to the second transfer line 4 downstream of shut-off valve b.

In FIG. 1, the second transfer line 4 is arranged in the storage tank S in such a manner that it is not led through the area of the storage tank S or of the inner tank 2 in which the liquid medium is stored.

FIG. 2 shows a different embodiment in which similar components are given the same reference numerals as in FIG. 1. In FIG. 2, the second transfer line 4' used for transferring the medium from the storage tank S into the liquefaction plant V is arranged in such a manner that when the liquid medium is present in the storage tank S (inner tank 2), the line 4' is routed at least partially through the portion of the storage tank S or of the inner tank 2 in which the liquefied medium is stored.

A further embodiment is shown in FIG. 3, and again similar components are given the same reference numerals. In FIG. 3, an outlet of the first transfer line 3 into the storage tank S is provided adjacent to a first side wall, Sx, of the tank S and an inlet of the second transfer line is provide adjacent to a side second wall, Sy, the second side wall being on the side of the tank S that is opposite to the first side wall. This means that the inlet of the second transfer line 4" (used for transferring the medium from the storage tank S into the liquefaction plant V) is located as far as possible from the outlet of the first transfer line 3. Furthermore, the second transfer line 4" is routed so that when the liquid medium is present in the storage tank S, the part of the transfer line 4" which is routed in the section of the inner tank 2 containing the liquid medium is maximized. In other words, the second transfer line 4" is routed so that, in use, as much of the line 4' is surrounded by the liquid medium as possible.

The arrangement of the transfer lines 3 and 4'/4" within the storage tank, as represented in FIGS. 2 and 3, is an improvement of the arrangement of the transfer lines 3 and 4' within the storage tank as represented in FIG. 1. If constructively possible, the arrangement as represented in FIG. 2, even more preferably FIG. 3 is thus always selected.

However, it will be appreciated that the arrangement and use of the bypass line 5 is independent of the arrangement of the transfer lines within the storage tank.

The by-pass line 5 can be provided at any point which connects the first transfer line 3 upstream of shut-off valve a; and the second transfer line 4 downstream of shut-off valve b. However, in a preferred embodiment the by-pass line 5 is provided in the immediate vicinity of, or substantially adjacent to, the storage tank. In practical terms, this means that it is arranged as close as constructively possible to the storage tank. This means that the lengths of those sections of the transfer lines that do not come in direct contact, during the cooling phase, with the medium circulating via the transfer lines and the bypass line are reduced or minimized. In other words, a maximum length of the transfer lines is cooled during the cooling phase, and only the relatively short lengths between the valves and the storage tank are not cooled.

The embodiments of the invention described above are operated in the manner described below.

After a standstill phase or the renewed startup of the liquefaction plant V, before the transfer of liquefied medium into the storage tank S, a cooling of the transfer lines is carried out. In the transfer lines cooling phase, liquefied medium is led from the liquefaction plant V via the transfer lines 3 and 4/4'/4" as well as the bypass line 5. During this cooling phase, the shut-off valves a and b are closed and only the shut-off valve c of the bypass line 5 is opened. Since the medium used for cooling the transfer lines 3 and 4/4'/4" is now not led through the storage tank S, the heat is effectively prevented from being introduced from the transfer line 3 into the storage tank S. The liquefied medium is fed through the by-pass line 5 until a predetermined, desired temperature is reached.

After the cooling of the transfer lines 3 and 4/4'/4" to the desired temperature has occurred, the shut-off valve c is closed and the shut-off valves a and b are opened. This means that the medium liquefied in the liquefaction plant V is now transferred via the transfer line 3 directly into the storage tank S. At the same time, medium can be transferred from the storage tank S via the transfer line 4/4'/4" back into the liquefaction plant V.

While the invention has been described above with reference to one or more preferred embodiments, it will be appreciated that various changes or modifications may be made without departing from the scope of the invention as defined in the appended claims.

The entire disclosures of all applications, patents and publications, cited herein and of corresponding United Kingdom patent application No. GB 1711975.1, filed Jul. 25, 2017 are incorporated by reference herein.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. An arrangement comprising:

at least one liquefaction plant (V) for liquefying a gaseous medium to produce a liquefied medium;

at least one storage tank (S) for storing the liquefied medium;

at least one first transfer line (3) connected between the liquefaction plant (V) and the storage tank (S), for transferring liquefied medium from the liquefaction plant (V) into the storage tank (S), said at least one first transfer line having at least one first shut-off valve (a);

at least one second transfer line (4, 4', 4"), connected between the liquefaction plant (V) and the storage tank (S), for transferring gaseous medium from the storage tank (S) into the liquefaction plant (V), said at least one second transfer line having at least one second shut-off valve (b);

a bypass line (5) connecting the at least one first transfer line (3) to the at least one second transfer line (3, 4, 4', 4"); and a bypass shut-off valve (c) provided in the by-pass line (5);

wherein the bypass line (5) connects said at least one first transfer line and said at least one second transfer line (3, 4, 4', 4") at a point between the liquefaction plant (V) and the shut-off valves (a, b) of the transfer lines.

2. The arrangement according to claim 1, further comprising a control element, wherein the control element, after a standstill phase of the liquefaction plant (V) and before transfer of liquefied medium from the liquefaction plant (V) into the storage tank (S), performs a transfer line cooling phase, in which the shut-off valves (a, b) of the transfer lines are closed and the bypass line shut-off valve (c) is opened, so that liquefied medium from the liquefaction plant (V) can flow through partial sections of the at least one first transfer line (3), the bypass line (5), the at least one second transfer line (4, 4', 4"), and back into the liquefaction plant (V).

3. The arrangement according to claim 1, wherein the bypass line (5) is arranged substantially adjacent to the storage tank (S).

4. The arrangement according to claim 1, wherein said arrangement comprises only one first transfer line (3) having one first shut-off valve (a), and only one second transfer line (4, 4', 4") having one second shut-off valve (b), and wherein the bypass line (5) is connected between a point on the first transfer line (3) upstream of the first shut-off valve (a) and a point on the second transfer line (4, 4', 4") downstream of the second shut-off valve (b).

5. The arrangement according to claim 1, wherein the second transfer line (4', 4") is routed at least partially through an area of the storage tank (S) in which the liquefied medium is stored in use.

6. The arrangement according to claim 5, wherein an outlet of the first transfer line (3) into the storage tank (S) is provided adjacent to a first side wall of the tank (S) and an inlet of the second transfer line is provide adjacent to a second side wall, said second side wall being provided on the side of the tank (S) opposite to the first side wall.

7. The arrangement according to claim 1, wherein the at least one second transfer line (4) is not routed through an area of the storage tank (S) in which the liquefied medium is stored in use.

8. The arrangement according to claim 1, wherein the storage tank (S) is a double-walled tank, having an outer tank (1) and an inner tank (2).

9. The arrangement according to claim 1, wherein at least some of the transfer lines are vacuum insulated.

10. A method for cooling the transfer lines (3, 4, 4') of an arrangement according to claim 1, after a standstill phase of the liquefaction plant (V), the method comprising:

operating a cooling mode wherein liquid medium is fed through the by-pass line that connects the at least one first transfer line and the at least one second transfer line, to by-pass the storage tank (S), and switching to a normal transfer mode wherein liquefied medium is transferred from the liquefaction plant (V) into the storage tank (S).

11. The method according to claim 10, wherein the cooling mode comprises:

closing transfer line shut-off valves (a, b) and opening bypass line shut-off valve (c), so that liquefied medium is led from the liquefaction plant (V), through the at least one first transfer line (3), the bypass valve (5), and the at least one second transfer line (4, 4', 4"), and back into the liquefaction plant (V).

12. The method according to claim 10, wherein the cooling mode is carried out until a predetermined temperature has been reached in at least one section of the transfer lines (3, 4, 4', 4').

13. The method according to claim 10, wherein the medium to be liquefied is hydrogen, a noble gas, oxygen, nitrogen, or a hydrocarbon mixture.

14. The arrangement according to claim 1, wherein the storage tank (S) is a vacuum insulated storage tank.

15. The method according to claim 13, wherein the medium to be liquefied is hydrogen, neon, argon, oxygen, nitrogen, or natural gas.

16. A method for cooling the transfer lines (3, 4, 4') of an arrangement according to claim 1, after a standstill phase of the liquefaction plant (V), the method comprising:

(a) operating a cooling mode wherein liquid medium is fed through the by-pass line that connects the at least one first transfer line and the at least one second transfer line, to by-pass the storage tank (S) and conduct liquid medium through part of said at least one first transfer line, said by-pass line, and part of said at least one second transfer line back to the liquefaction plant (V), and (b) switching to a normal transfer mode wherein liquefied medium is transferred from the liquefaction plant (V) into the storage tank (S).

* * * * *